US007953336B2

(12) United States Patent
Hamaya

(10) Patent No.: US 7,953,336 B2
(45) Date of Patent: May 31, 2011

(54) IMAGE FORMING APPARATUS WITH RECOVERY UNIT

(75) Inventor: Masahito Hamaya, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 129 days.

(21) Appl. No.: 12/406,291

(22) Filed: Mar. 18, 2009

(65) Prior Publication Data

US 2009/0245829 A1 Oct. 1, 2009

(30) Foreign Application Priority Data

Mar. 26, 2008 (JP) ..... 2008-080621

(51) Int. Cl.
*G03G 15/16* (2006.01)
*G03G 21/00* (2006.01)

(52) U.S. Cl. ..... 399/66; 399/34

(58) Field of Classification Search ..... 399/9, 31, 399/34, 66, 71, 149
See application file for complete search history.

(56) References Cited

U.S. PATENT DOCUMENTS

| | | | | |
|---|---|---|---|---|
| 5,291,253 | A * | 3/1994 | Kumasaka et al. | 399/66 |
| 5,893,659 | A * | 4/1999 | Nanjo et al. | 399/66 X |
| 2006/0171735 | A1 | 8/2006 | Hamada et al. | |
| 2008/0273891 | A1 | 11/2008 | Hamada et al. | |

FOREIGN PATENT DOCUMENTS

| | | |
|---|---|---|
| JP | 05-019670 | 1/1993 |
| JP | 2002-072602 | 3/2002 |
| JP | 2003-131536 | 5/2003 |
| JP | 2006-285202 | 10/2006 |
| JP | 2007-057557 | 3/2007 |

OTHER PUBLICATIONS

Notification of Reason for Refusal for Japanese Patent Application 2008-080621, mailed Nov. 10, 2009.

* cited by examiner

*Primary Examiner* — Sandra L Brase
(74) *Attorney, Agent, or Firm* — Banner & Witcoff, Ltd.

(57) ABSTRACT

An image forming apparatus comprises an image carrier configured to hold a developing agent image; a transfer unit that transfers the developing agent image to a recording medium; a first application unit that controls a transfer voltage applied to the transfer unit; a recovery unit that recovers the developing agent remaining on the image carrier; a second application unit that controls a recovery voltage applied to the recovery unit; a determination unit that determines whether or not a recovery current flowing between the image carrier and the recovery unit exceeds a first predetermined current value; and a control unit that, when the determination unit makes a positive determination that the recovery current has exceeded the first predetermined current value, performs a protective control for controlling the first application unit such that a transfer current flowing between the image carrier and the transfer unit becomes greater.

9 Claims, 11 Drawing Sheets

IMAGE FORMING APPARATUS WITH RECOVERY UNIT

CROSS REFERENCE TO RELATED APPLICATION

The present application claims priority from Japanese Patent Application No. 2008-080621, which was filed on Mar. 26, 2008, the disclosure of which is herein incorporated by reference in its entirety.

TECHNICAL FIELD

Apparatus and devices consistent with the present invention relate to an electro-photographic image forming apparatus.

BACKGROUND

An electro-photographic image forming apparatus forms an image by transferring a developing agent image held on an image carrier, such as a photosensitive drum, to a recording medium, such as a recording sheet.

Provided that not all the developing agent held on the photosensitive drum is transferred to the recording sheet and that some of the developing agent still remains on the photosensitive drum, the residual developing agent may be transferred to the sheet during the next image forming operation.

Therefore, for instance, Japanese unexamined patent application publication No. JP-A-2002-72602 describes a related art image forming apparatus. In the related art image forming apparatus, there is provided a cleaning roller that is applied with a voltage opposite in polarity to the developing agent held on the photosensitive drum, and a developing agent remaining on the photosensitive drum is recovered by the cleaning roller.

SUMMARY

However, the related art image forming apparatus has a few disadvantages. For example, in the related art image forming apparatus, the photosensitive drum is also electrified, and hence an electric current may flow to the cleaning roller from the electrified photosensitive drum.

If an electric current flows from the photosensitive drum to the cleaning roller, a voltage to be applied to the cleaning roller must be increased in accordance with an increase in the inflow current, which results in an increase in the size of a high-voltage power circuit, or the like, for applying a voltage to the cleaning roller, and, an increase in the size of the image forming apparatus.

Exemplary embodiments of the present invention address the above disadvantages and other disadvantages not described above. However, the present invention is not required to overcome the disadvantages described above, and thus, an exemplary embodiment of the present invention may not overcome any of the problems described above.

It is an aspect of the present invention to prevent an increase in the size of an image forming apparatus by preventing flow of an excessive current to recovery unit, such as a cleaning roller.

According to an exemplary embodiment of the present invention, there is provided an image forming apparatus comprising: an image carrier that is configured to hold a developing agent image; a transfer unit that transfers the developing agent image held on the image carrier to a recording medium; a first application unit that controls a transfer voltage applied to the transfer unit; a recovery unit that recovers the developing agent remaining on the image carrier; a second application unit that controls a recovery voltage applied to the recovery unit; a determination unit that determines whether or not a recovery current flowing between the image carrier and the recovery unit exceeds a first predetermined current value; and a control unit that, when the determination unit makes a positive determination that the recovery current has exceeded the first predetermined current value, performs a protective control for controlling the first application unit such that a transfer current flowing between the image carrier and the transfer unit becomes greater than the transfer current achieved before the positive determination is determined.

Thereby, according to the above exemplary embodiment, when the recovery current exceeds a first predetermined current value, the protective control is performed in such a way that the transfer current becomes greater than that achieved before the positive determination is determined, and a surface potential of the image carrier decreases. Hence, flow of an inflow current between the image carrier and the recovery unit is prevented.

BRIEF DESCRIPTION OF THE DRAWINGS

Illustrative aspects of the present invention will be described in detail with reference to the following figures wherein.

DETAILED DESCRIPTION OF EXEMPLARY EMBODIMENTS OF THE PRESENT INVENTION

The exemplary embodiments of the present invention are adopted to a monochrome laser printer. Further, the exemplary embodiments are described hereunder along with the drawings.

First Exemplary Embodiment

1. Descriptions of the Drawings

Figure 1:
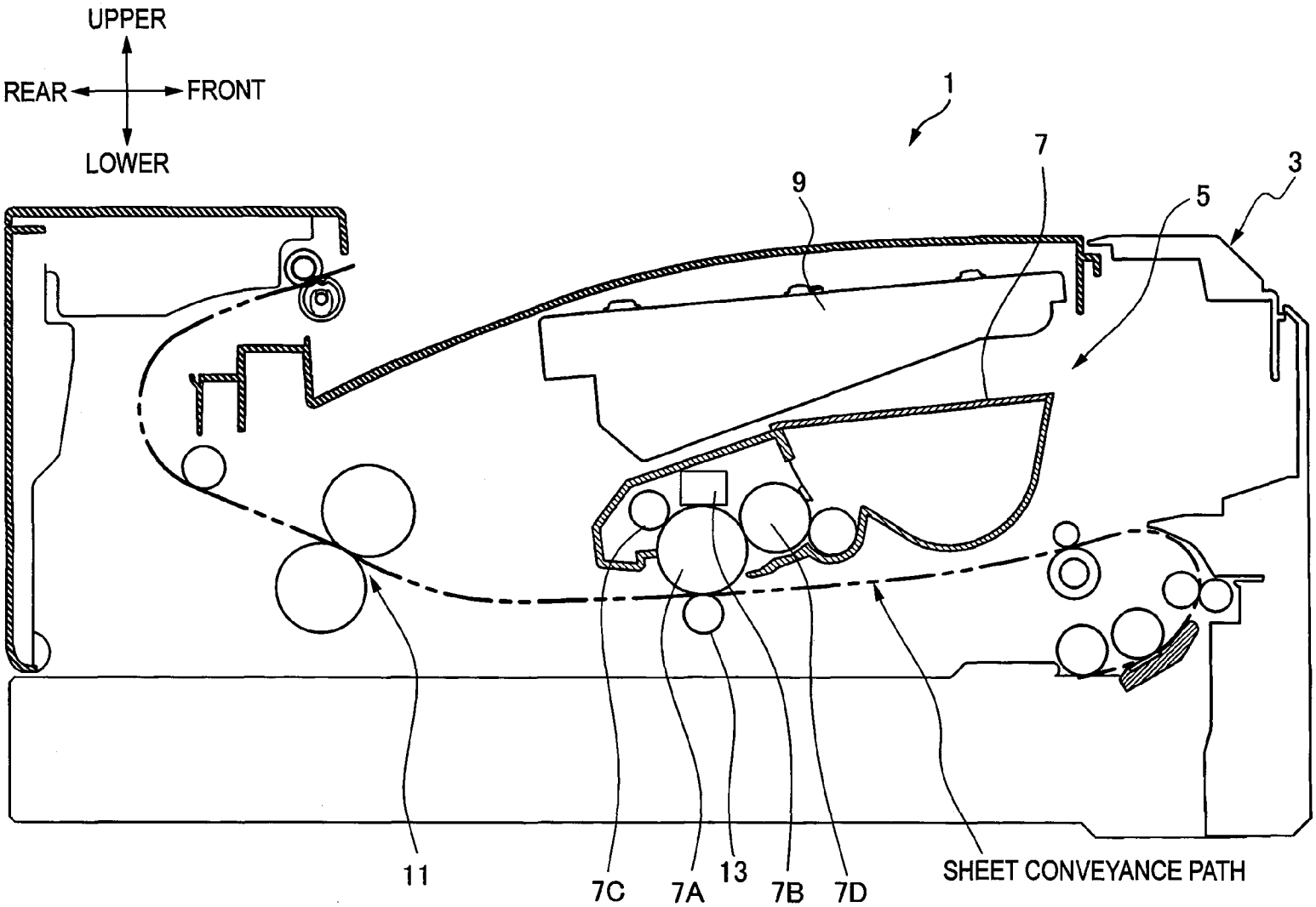
FIG. 1 is a cross-sectional central view of an image forming apparatus 1 according to a first exemplary embodiment of the present invention.
Figure 2:
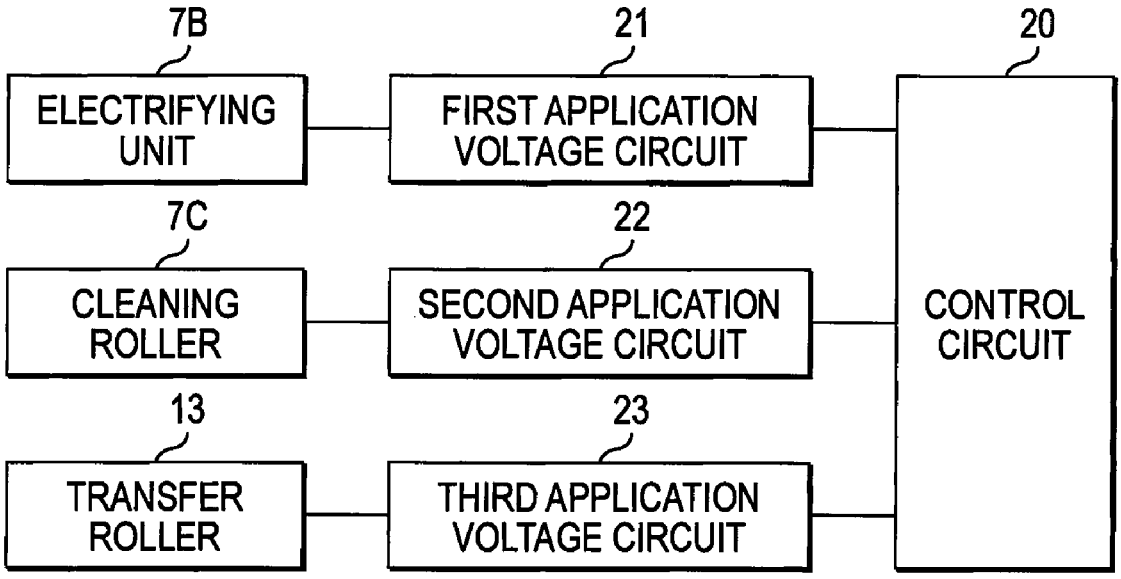
FIG. 2 is a block diagram of an electric system of the image forming apparatus 1 according to the first exemplary embodiment of the present invention.
Figure 3:
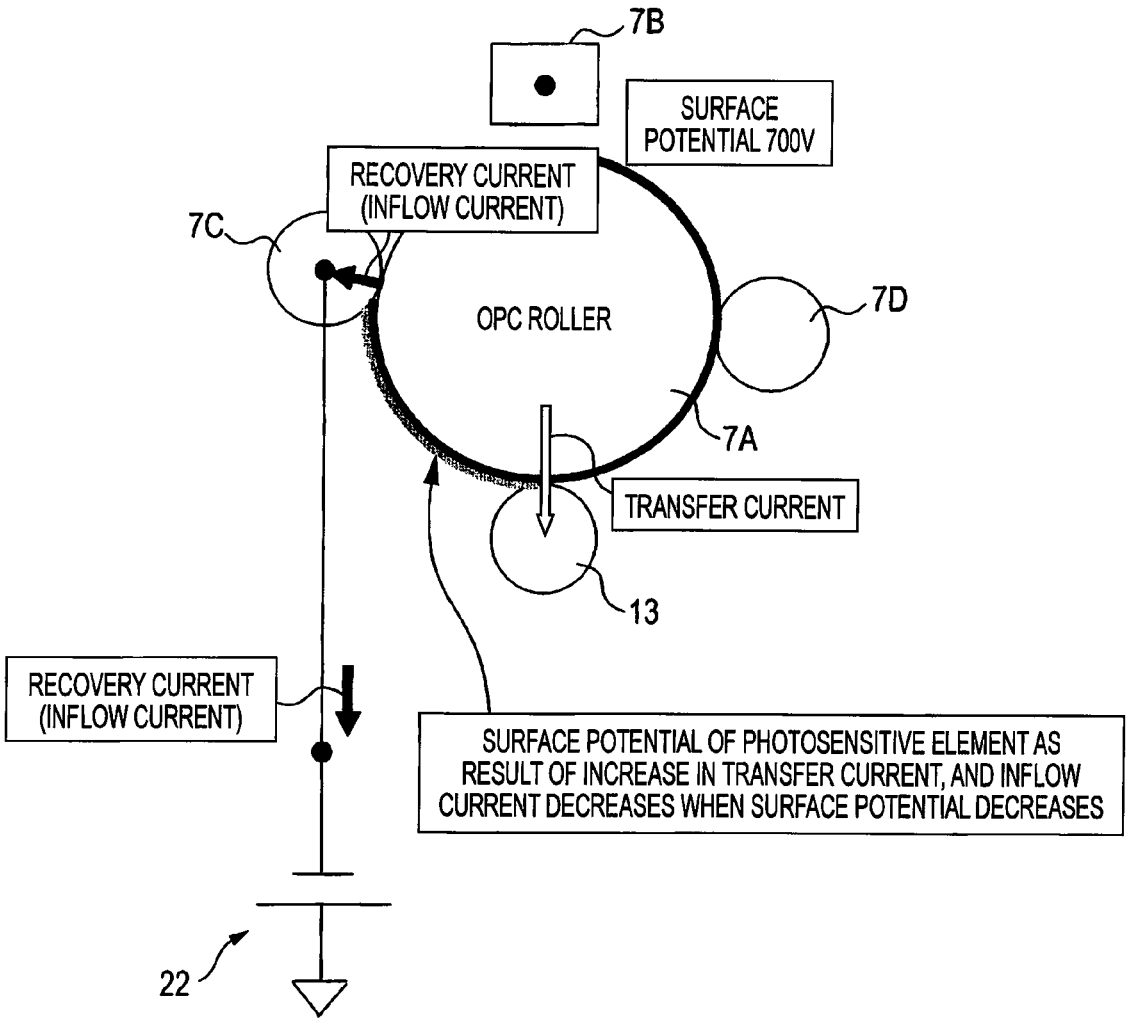
FIG. 3 is a descriptive view of a recovery current and a transfer current.
Figure 4:
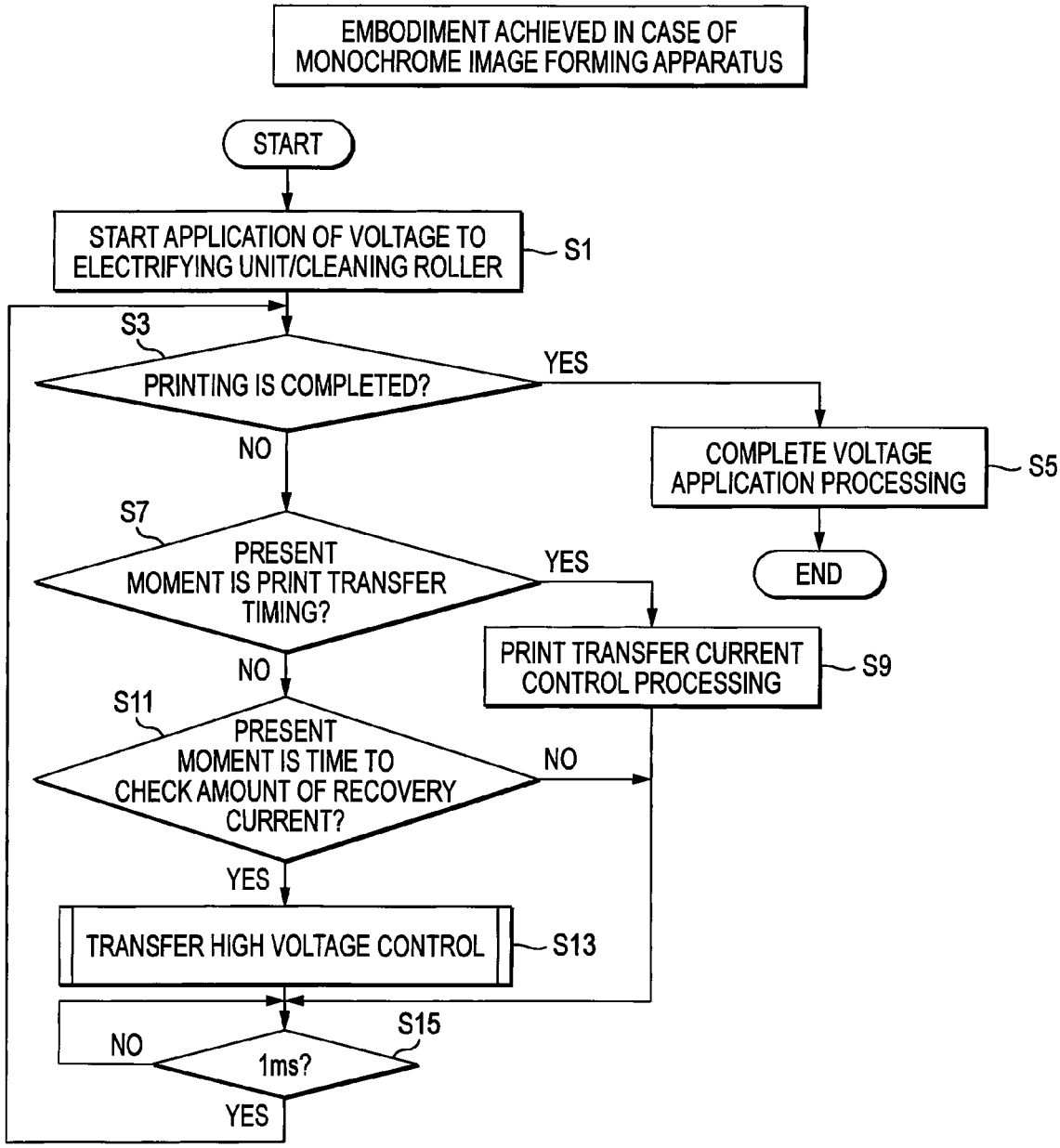
FIG. 4 is a flowchart showing main control operation of the image forming apparatus according to the first exemplary embodiment.
Figure 5:
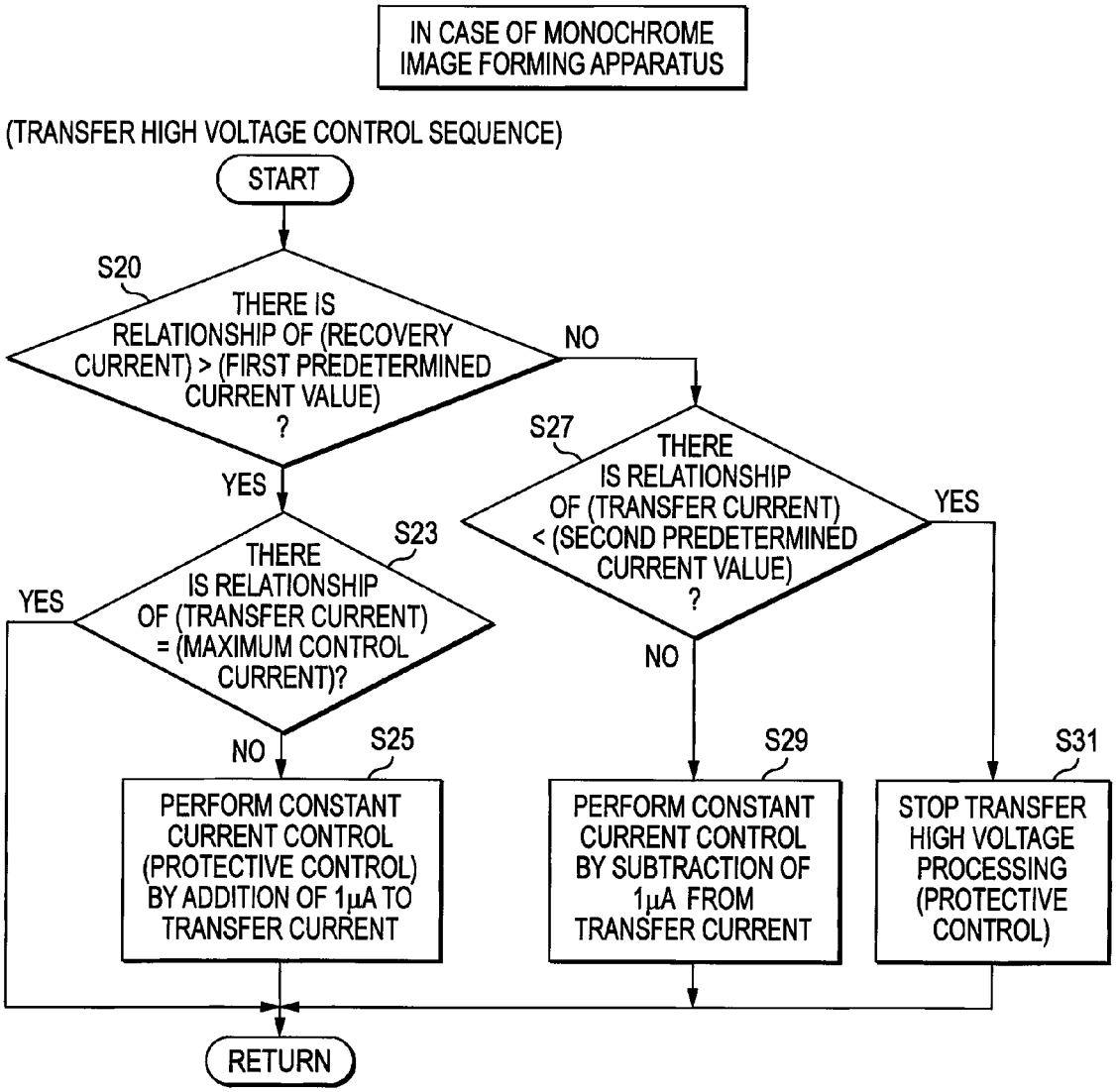
FIG. 5 is a flowchart showing transfer high-voltage control of the image forming apparatus according to the first exemplary embodiment.

FIG. 1 is a cross-sectional central view of an image forming apparatus 1 of the first exemplary embodiment; FIG. 2 is a block diagram of an electric system of the image forming apparatus 1; FIG. 3 is a descriptive view of a recovery current and a transfer current; FIG. 4 is a flowchart showing main control operation of the image forming apparatus of the first exemplary embodiment; and FIG. 5 is a flowchart showing transfer high-voltage control of the image forming apparatus of the first exemplary embodiment.

2. Overview of the Image Forming Apparatus 2.1. General Structure of the Image Forming Apparatus (See FIG. 1)

As shown in FIG. 1, an electro-photographic image forming unit 5 that forms an image on a sheet by transferring a developing agent image on a recording sheet (hereinafter called a "sheet"), such as a recording sheet and an OHP sheet, is housed in a housing 3 of the image forming apparatus 1. As is well known, the image forming unit 5 comprises a process cartridge 7, an exposure unit 9, and a fixing unit 11.

The process cartridge 7 houses a photosensitive drum 7A holding a developing agent image; an electrifying unit 7B for electrifying the photosensitive drum 7A; a cleaning roller 7C for recovering a developing agent still remaining on the photosensitive drum 7A; a developing roller 7D for supplying the photosensitive drum 7A with a developing agent; and the like.

The photosensitive drum 7A electrified by the electrifying unit 7B is exposed by the exposure unit 9, whereupon an electrostatic latent image is formed on an outer peripheral surface of the photosensitive drum 7A. Subsequently, an electrically charged developing agent is supplied from the developing roller 7D to the photosensitive drum 7A, whereby the developing agent image is held (formed) on the outer peripheral surface of the photosensitive drum 7A.

Incidentally, in the first exemplary embodiment, the developing agent is positively charged, and, on the other hand, an area of the photosensitive drum 7A that is not exposed by the exposure unit 9 still remains at an electric potential (a positive potential) electrically charged by the electrifying unit 7B. The area exposed by the exposure unit 9; namely, the area of the electrostatic latent image, becomes lower than the unexposed area in terms of an electric potential. The electrically charged developing agent is attracted on the area of the electrostatic latent image, whereby the developing agent image is held on the outer peripheral surface of the photosensitive drum 7A.

A transfer roller 13 for transferring the developing agent image held on the photosensitive drum 7A to a sheet is disposed at a position that is opposite to the photosensitive drum 7A across a conveyed sheet interposed therebetween. The transfer roller 13 is applied with an electric potential (a negative potential in the first exemplary embodiment) that is opposite in polarity to the developing agent held on the photosensitive drum 7A.

The cleaning roller 7C is recovery unit that is applied with an electric potential (a negative potential in the first exemplary embodiment) which is opposite in polarity to the developing agent held on the photosensitive drum 7A, as in the case of the transfer roller 13, thereby transferring the developing agent still remaining on the photosensitive drum 7A to the cleaning roller 7C, to thus recover (clean) the developing agent.

When the number of sheets having images formed by the image forming unit 5 exceeds a predetermined number, the cleaning roller 7C is applied with an electric potential (a positive potential in the first exemplary embodiment) that is identical in polarity with the developing agent. The developing agent recovered from the cleaning roller 7C applied with the electric potential that is identical in polarity with the developing agent is returned to the surface of the photosensitive drum 7A, and the developing agent returned to the photosensitive drum 7A is recovered by the developing roller 7D.

Subsequently, when the number of sheets on which images are formed again exceeds a predetermined number, the same processing is performed. Even when there is an increase in the amount of developing agent recovered by the cleaning roller 7C, deterioration of recovery performance can be prevented by periodic repetition of such processing.

2.2. Block Diagram of an Electric System (See FIG. 2)

As shown in FIG. 2, a first application voltage circuit 21 applies an electric potential to the electrifying unit 7B; a second application voltage circuit 22 applies an electric potential to the cleaning roller 7C; and a third application voltage circuit 23 applies an electric potential to the transfer roller 13. These application voltage circuits 21 to 23 are controlled by the control circuit 20.

The control circuit 20 comprises a microcomputer consisting of a CPU, ROM, RAM, and others. The second application voltage circuit 22 and the third application voltage circuit 23 controls an application voltage by means of PWM control.

3. Characteristic Operation Control of the Image Forming Apparatus of the Present Embodiment 3.1. Overview of Control Operation (see FIG. 3)

As mentioned previously, a potential difference exists between the photosensitive drum 7A and the cleaning roller 7C. Hence, when a residual developing agent is recovered, an electric current (this electric current will be hereunder called an "inflow current") may flow into the electrified photosensitive drum 7A to the cleaning roller 7C along with the electric current flowing from the photosensitive drum 7A to the cleaning roller 7C (this electric current will be hereinafter called a "recovery current"), thereby increasing an apparent recovery current.

For this reason, there arises a necessity for increasing a control voltage to be applied to the cleaning roller 7C for recovering the developing agent, which may result in an increase in the size of the second application voltage circuit 22 and, an increase in the size of the image forming apparatus 1.

Accordingly, in the first exemplary embodiment, when the recovery current (including the inflow current) flowing between the photosensitive drum 7A and the cleaning roller 7C is determined to exceed a first predetermined current value (this determination will be described hereunder as a "positive determination"), the third application voltage circuit 23 is controlled such that the electric current (this current will be hereinafter called a "transfer current") flowing between the photosensitive drum 7A and the transfer roller 13 becomes greater than that achieved before rendering of a positive determination (the control operation is hereinafter called "protective control").

The transfer current does not arise only during protective control. In the image forming apparatus of the first exemplary embodiment, a potential difference between the photosensitive drum 7A and the transfer roller 13 is generated so as to transfer the developing agent image to a sheet. Hence, a transfer current arises even at the time of formation of an image (printing operation).

Detailed descriptions are provided below by reference to flowcharts shown in FIGS. 4 and 5.

3.2. Protective Control 3.2.1. Main Control (See FIG. 4)

Main control shown in FIG. 4 is started when a print command is issued to the image forming apparatus 1. A program executed for performing main control (FIG. 4) and transfer high voltage control (FIG. 5) to be described later is stored in the ROM of the control circuit 20, and the control circuit 20 (CPU) performs main control and transfer high voltage control in accordance with the program.

When main control is started, processing for applying a voltage to the electrifying unit 7B and the cleaning roller 7C is first started (S1). Image forming processing is initiated, and a determination is made as to whether or not image forming processing (printing) is completed (S3).

In the first exemplary embodiment, passage of a sheet through a sensor is detected by means of an output from the sensor provided along a path in which a sheet is conveyed, and a determination is made, on the basis of a detection result, as to whether or not image formation processing is completed.

Specifically, when a leading edge of the sheet in the direction of conveyance has not yet passed by the sensor despite lapse of a predetermined period of time or longer since a trailing edge of the sheet in the direction of conveyance passed by the sensor, image formation processing is determined to have completed. Meanwhile, when the leading edge of the sheet in the direction of conveyance passes by the sensor within a predetermined period of time after the trailing edge of the sheet in the direction of conveyance has passed by the sensor, image formation processing is determined not to complete yet.

When image formation processing is determined to have completed (YES in S3), control operation ends after processing for applying a voltage to the electrifying unit 7B and the cleaning roller 7C has been stopped (S5). In the meantime, when image formation processing is determined not to complete yet (NO in S3), a determination is made as to whether or not the present moment is a time to transfer a developing agent image held on the photosensitive drum 7A to a sheet (hereinafter called "transfer timing") (S7).

At this time, when the present moment is determined to be transfer timing (YES in S7), print transfer current control processing is performed (S9). Print transfer current control processing refers to control operation for controlling the third application voltage circuit 23 such that a transfer current comes to a predetermined current value for forming an image.

When print transfer current control processing (S9) is completed, a determination is made as to whether or not a predetermined period of time (1 millisecond in the present embodiment) has elapsed (S15). When a predetermined period of time is determined not to have elapsed (NO in S15), the apparatus stays in a standby condition until a predetermined period of time elapses. In the meantime, when a predetermined period of time is determined to have elapsed (YES in S15), processing pertaining to S3 is again performed.

When the present moment is determined not to be transfer timing in S7 (NO in S7), it is determined whether or not the present moment is a time to check the amount of recovery current (S11). When the present moment is determined to be a time to check the amount of recovery current (YES in S11), transfer high voltage control operation to be described later is performed (S13), and subsequently processing pertaining to S15 is carried out. In the meantime, when the present moment is determined not to be a time to check the amount of recovery current (NO in S11), processing pertaining to S15 is performed without performance of transfer high voltage control.

The time to check the amount of recovery current refers to timing at which an area of the photosensitive drum 7A opposing the transfer roller 13; namely, an area to be subjected to transfer operation, reaches the cleaning roller 7C.

In short, the developing agent that is not transferred to the sheet from the photosensitive drum 7A at transfer timing is a residual developing agent to be recovered by the cleaning roller 7C. Accordingly, recovery of the residual developing agent is carried out at timing when the area to be subjected to transfer operation reaches the cleaning roller 7C.

When the residual developing agent is recovered, the recovery current including the inflow current flows between the cleaning roller 7C and the photosensitive drum 7A as mentioned previously. Therefore, in the first exemplary embodiment, when the present moment is determined to be a time to check the amount of recovery current, transfer high voltage control for performing protective control operation is performed. Incidentally, in the first exemplary embodiment, a time achieved after elapse of about 170 milliseconds since the transfer timing comes to the time to check the amount of recovery current.

3.2.2. Transfer High Voltage Control (See FIG. 5)

As mentioned previously, when the present moment is determined to be a time to check the amount of recovery current (YES in S11), transfer high voltage control operation (see FIG. 5) including performance of protective control operation is practiced. A transfer current shown in FIG. 5 indicates an absolute value (only the magnitude) of an electric current. In the image forming apparatus 1 of the first exemplary embodiment, a transfer current and a recovery current (including an inflow current) flow in a direction shown in FIG. 3.

When transfer high voltage control is started, it is determined whether or not the recovery current currently flowing to the cleaning roller 7C exceeds a first predetermined value (S20). When the recovery current is determined to exceed the first predetermined value; namely, when a positive determination is rendered (YES in S20), it is determined whether or not the present transfer current is the upper limit of a controllable (variable) range (S23).

In the first exemplary embodiment, a determination as to whether or not the recovery current exceeds the first predetermined value is made on the basis of an electric potential applied to the cleaning roller 7C (the control voltage of the second application voltage circuit 22). Likewise, a determination as to whether or not the transfer current is the upper limit of the controllable range is made on the basis of an electric potential applied to the transfer roller 13 (the control voltage of the third application voltage circuit 23).

When the present transfer current is determined to be the upper limit of the controllable range (YES in S23), the transfer current cannot be increased further even when a positive determination is rendered. Hence, control operation is completed without modification of the transfer current (the application voltage of the second application voltage circuit 22), and processing returns to main control operation.

It is extremely rare that the present transfer current exceeds the upper limit of the controllable range (YES in S23). However, if the present transfer current exceeds the upper limit of the controllable range, the recovery performance of the cleaning roller 7C will decrease, and image quality of a printed sheet will also be degraded. Therefore, when image quality is degraded, it is desirable to take measures, such as maintenance of the image forming apparatus 1 performed by a service engineer.

In the meantime, when the present transfer current is determined not to be the upper limit of the controllable range (NO in S23), transfer high voltage control is performed by increasing the transfer current to a level achieved before a positive determination is rendered in S20, and a decrease in recovery current is deemed to be necessary. The third application voltage circuit 23 is controlled such that a transfer current, which is larger than the present transfer current by a predetermined value (1 μA) and which is smaller than a transfer current for transferring a developing agent image (performing printing operation), flows (S25). Subsequently, control operation is completed, and processing returns to main control operation.

When a positive determination is not rendered in S20 (NO in S20), it is determined whether or not the transfer current is less than a second predetermined current value (S27). When the transfer current is determined not to be less than the second predetermined current value (NO in S27), transfer high voltage control must be performed. However, it is assumed that the recovery current can be reduced at the magnitude of the present transfer current without performance of transfer high voltage control, and the third application voltage circuit 23 is controlled such that a transfer current, which is smaller than the present transfer current by a predetermined value, flows (S29). Subsequently, control operation is completed, and processing returns to main control operation.

In the meantime, when the transfer current is determined to be less than the second predetermined current value in S27 (YES in S27), it is assumed that the recovery current can be made small without performance of transfer high voltage control. Transfer high voltage control is suspended, and the control voltage is returned to a set voltage (S31). Subsequently, control operation is completed, and processing returns to main control operation. Transfer high voltage control (processing) refers to control processing for increasing the transfer current in order to reduce the recovery current; namely, protective control.

4. Characteristic of the Image Forming Apparatus of the First Exemplary Embodiment In the first exemplary embodiment, when the recovery current (including the inflow current) exceeds the first predetermined current value, there is performed protective control for making the transfer current larger than that achieved before rendering of a positive determination. Hence, flow of an inflow current between the photosensitive drum 7A and the cleaning roller 7C is prevented.

Therefore, flow of an excessive current to the cleaning roller 7C and the second application voltage circuit 22 can be prevented; hence, an increase in the size of the image forming apparatus can be prevented.

In the first exemplary embodiment, when the recovery current becomes less than the second predetermined current value, protective control is halted, so that performance of protective control that is not necessary can be prevented.

The first predetermined current and the second predetermined current are determined, as required, from various factors, such as materials of the photosensitive drum 7A and the cleaning roller 7C, the capability of the second application voltage circuit 22, the type of a developing agent, and the like. Therefore, the first predetermined current and the second predetermined current are usually determined for specifications of each image forming apparatus.

In the first exemplary embodiment, during protective control operation, the second application voltage circuit 22 is controlled such that a transfer current, which is smaller than that flowing at the time of transfer of a developing agent image, flows. Hence, flow of a large transfer current can be prevented, and early deterioration of the photosensitive drum 7A can be prevented.

In the first exemplary embodiment, after completion of transfer high voltage control, processing returns to main control. Therefore, when a positive determination is again rendered after performance of protective control, protective control is again performed. The third application voltage circuit 23 is controlled such that the transfer current becomes greater than that achieved before the positive determination is again rendered. Hence, flow of an excessive recovery current to the cleaning roller 7C and the second application voltage circuit 22 can be prevented without fail.

5. Correlation Between a Matter for Defining the Invention and the Embodiment

In the first exemplary embodiment, the photosensitive drum 7A corresponds to an image carrier; the transfer roller 13 corresponds to a transfer unit; the cleaning roller 7C corresponds to a recovery unit; and processing pertaining to S20 corresponds to a determination unit.

Processing pertaining to S25 and S29 corresponds to a control unit; the second application voltage circuit 22 corresponds to a second application unit; and the third application voltage circuit 23 corresponds to a first application unit.

Second Exemplary Embodiment

Figure 6:
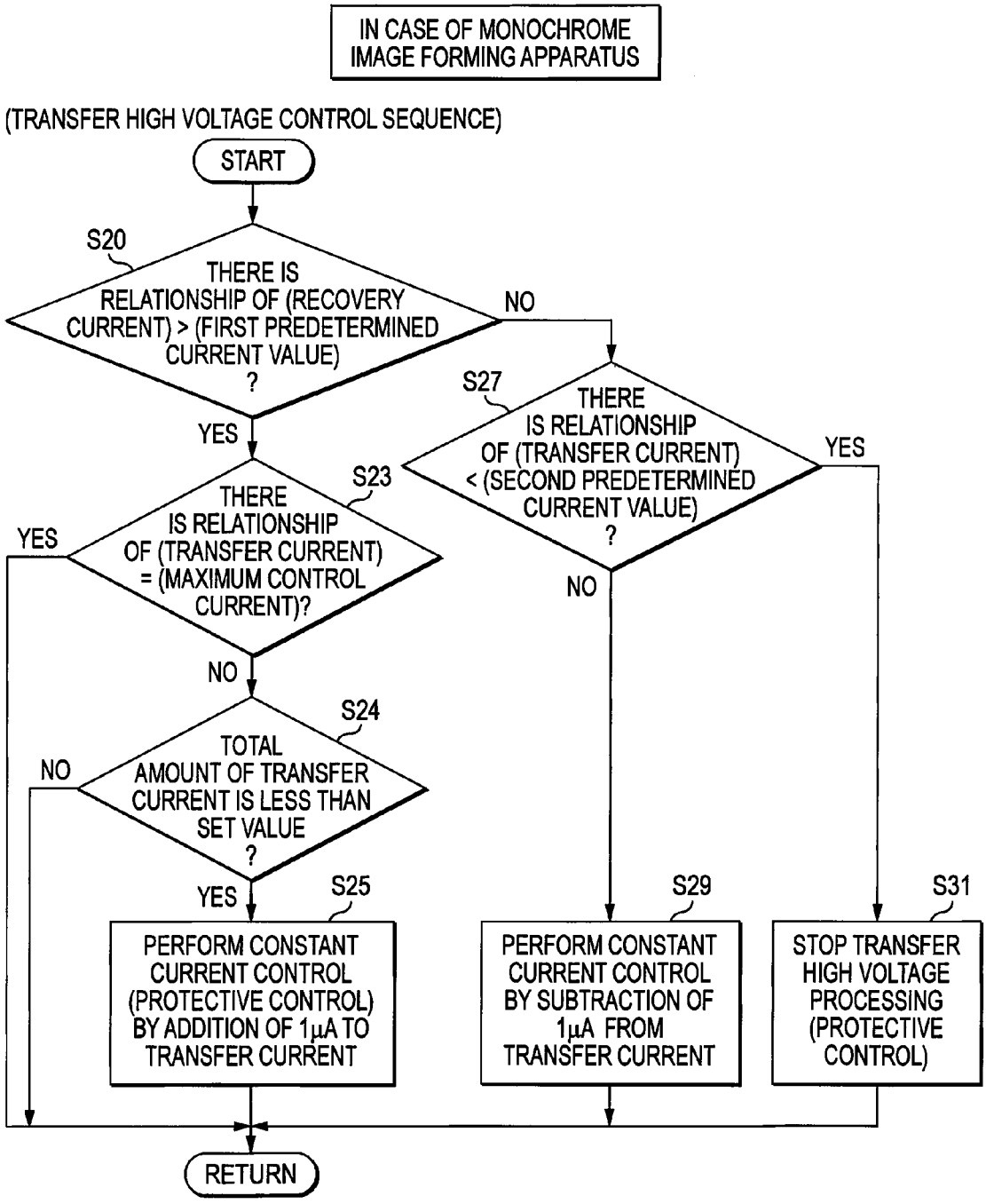
FIG. 6 is a flowchart showing transfer high-voltage control of the image forming apparatus according to a second exemplary embodiment.

As shown in FIG. 6, in transfer high voltage control operation of the second exemplary embodiment, when a positive determination is rendered, when the present transfer current is less than the upper limit of the controllable range, and when a total amount of transfer current flowed along with protective control operations performed thus far is less than a predetermined amount of current (YES in S24), protective control is again performed.

In the meantime, when the total amount of transfer current flowed along with protective control operations performed thus far (the amount of current will be hereinafter described as a "total amount of transfer current") becomes equal to or greater than the predetermined amount of current (NO in S24), processing returns to main control without performance of protective control (S25).

Thus, in the second exemplary embodiment, flow of an excessive transfer current to the photosensitive drum 7A can be prevented; hence, early deterioration of the photosensitive drum 7A can be prevented without fail.

Transfer high voltage control (FIG. 6) of the second exemplary embodiment differs from transfer high voltage control (FIG. 5) of the first exemplary embodiment only in term of presence of processing pertaining to S24. In other respects, the transfer high voltage control operation of the second exemplary embodiment is identical with that of the first exemplary embodiment.

Incidentally, the total amount of transfer current refers to an integrated value of a transfer current (except a transfer current used for printing) acquired since a power switch of the image forming apparatus 1 was turned on. Accordingly, in the second exemplary embodiment, the total amount of transfer current is detected on the basis of a control voltage from the third application voltage circuit during performance of protective control operation as well as the number of times protective control (S25) is performed since the power switch was turned on.

The predetermined amount of electric current is a value that varies according to the quality of a material of the photosensitive drum 7A, the type of a developing agent, and the like. In the second exemplary embodiment, a value determined by an experiment is adopted.

Third Exemplary Embodiment

In the above described exemplary embodiments, the present invention is applied to a monochrome image forming apparatus. However, in a third exemplary embodiment, the present invention is applied to a color image forming apparatus.

Figure 7:
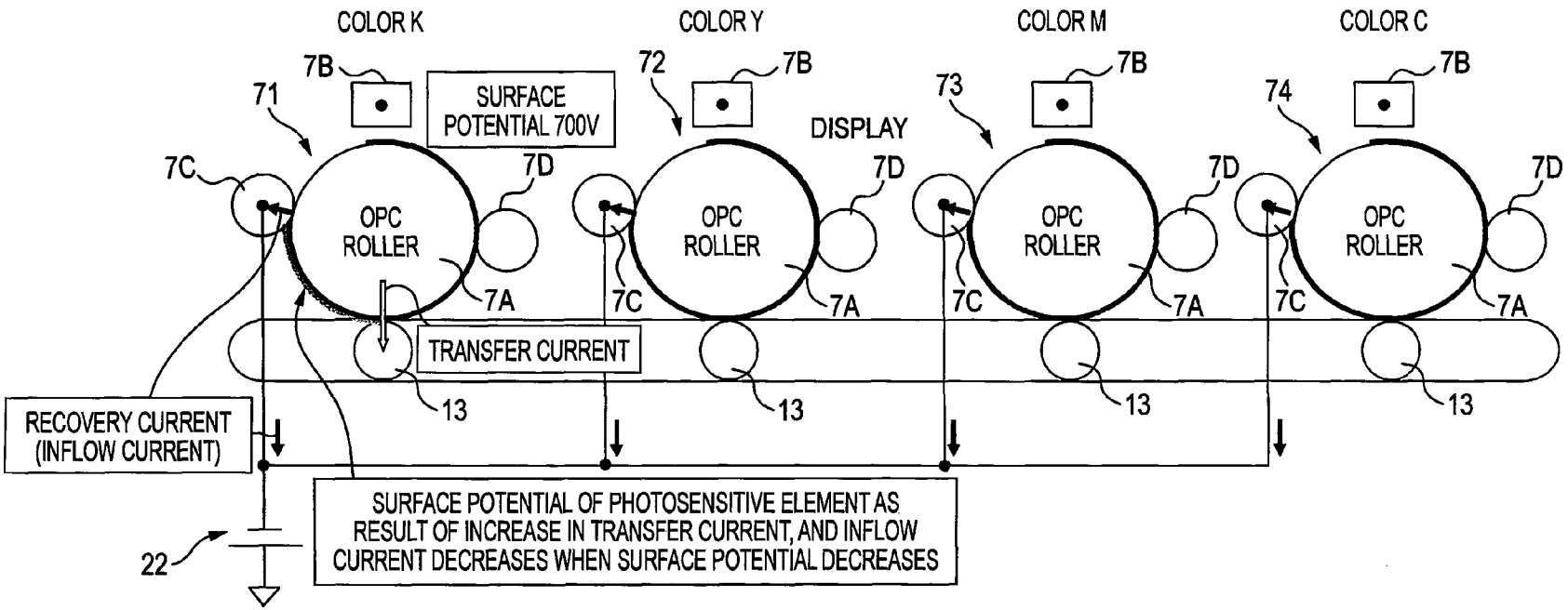
FIG. 7 is an overview of an image forming unit according to a third exemplary embodiment of the present invention.
Figure 8:
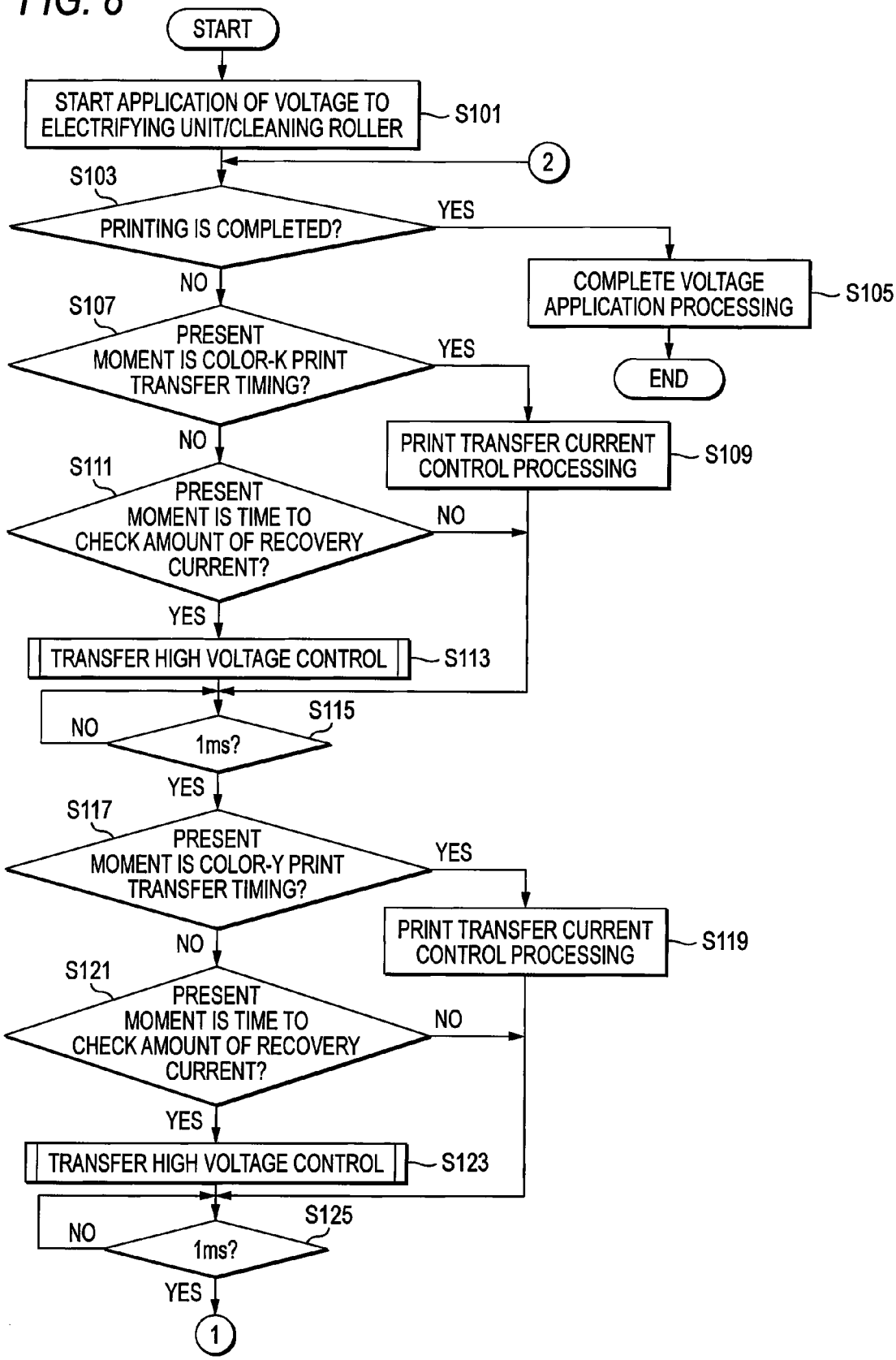
FIG. 8 is a flowchart showing main control operation of the image forming apparatus according to the third exemplary embodiment.
Figure 9:
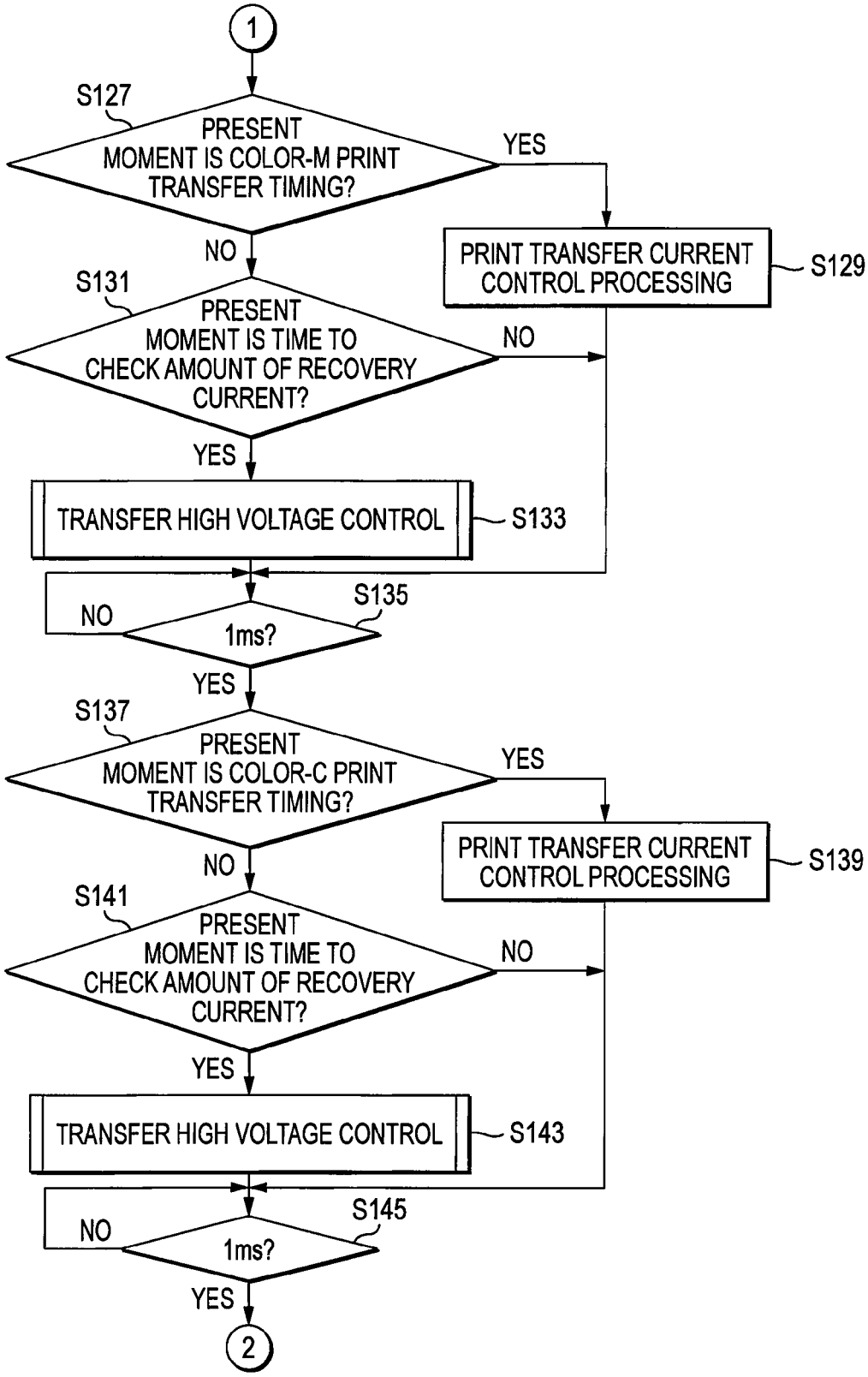
FIG. 9 is a flowchart showing main control operation of the image forming apparatus according to the third exemplary embodiment.
Figure 10:
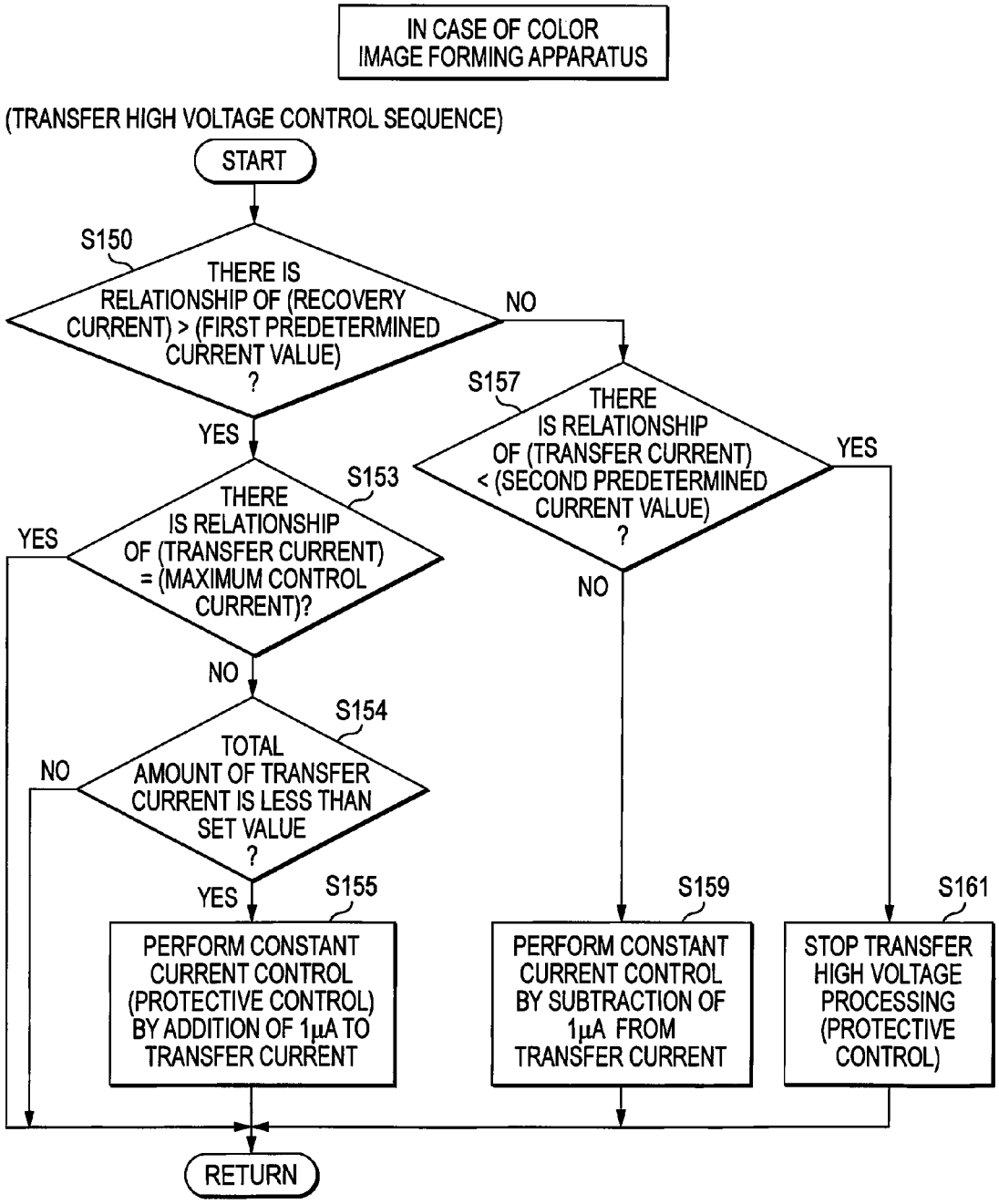
FIG. 10 is a flowchart showing transfer high-voltage control of the image forming apparatus according to the third exemplary embodiment.

FIG. 7 is a schematic view showing an overview of the image forming unit 5 of the third exemplary embodiment; FIGS. 8 and 9 are flowcharts showing main control employed in the third exemplary embodiment; and FIG. 10 is a flowchart showing transfer high voltage control.

1. Overview of an Image Forming Unit of the Third Exemplary Embodiment (See FIG. 7)

The image forming unit 5 of the third exemplary embodiment is an image forming unit of direct tandem type. Specifically, the image forming unit comprises, in sequence from an upstream in the direction of conveyance of a sheet, a black process cartridge 71, a yellow process cartridge 72, a magenta process cartridge 73, and a cyan process cartridge 74.

The respective process cartridges 71 to 74 differ from each other solely in terms of the color of a stored developing agent. Since the cartridges are structurally identical with the monochrome process cartridge 7, their detailed explanations are omitted.

Application of an electric potential to the cleaning rollers 7C provided for the respective process cartridges 71 to 74 is controlled by the common second application voltage circuit 22, and application of an electric potential to the respective transfer rollers 13 is controlled by different third application voltage circuits 23 from each other. That is, the transfer rollers 13 are controlled by the third application voltage circuits 23, respectively.

2. Characteristic Operation Control of the Image Forming Apparatus of the Present Embodiment 2.1. Summary of Control Operation Even in the third exemplary embodiment, when a positive determination is rendered and when the present transfer current is less than the upper limit of the controllable range, protective control is performed in a case where the total amount of transfer current is less than a predetermined amount of electric current, as in the second exemplary embodiment.

However, in the third exemplary embodiment, the apparatus has the four process cartridges 71 to 74. Therefore, the process cartridge 71 is first subjected to transfer high voltage control. Subsequently, the process cartridge 72, the process cartridge 73, and the process cartridge 74 are sequentially subjected to transfer high voltage control.

Therefore, in the third exemplary embodiment, even when protective control is performed during the course of; for instance, transfer high voltage control of the process cartridge 71, the process cartridge 72 is also subjected to protective control while the process cartridge 71 is in the middle of undergoing protective control in a case where a positive determination is rendered during transfer high voltage control operation of the process cartridge 72.

Likewise, when a positive determination is rendered when the process cartridge 73 is subjected to transfer high voltage control, the process cartridge 73 is also subjected to protective control while the process cartridges 71 and 72 are in the middle of undergoing protective control. When a positive determination is rendered during transfer high voltage control of the process cartridge 74, the process cartridge 74 is also subjected to protective control while the process cartridges 71 to 73 are in the middle of undergoing protective control.

As mentioned above, in the third exemplary embodiment, when a positive determination is rendered even after performance of protective control, the number of transfer rollers 13 subjected to protective control is increased as compared with that achieved before the positive determination is again rendered.

Detailed descriptions will be provided below by reference to the flowcharts shown in FIGS. 8 and 9.

2.2. Protective Control 2.2.1. Main Control (See FIGS. 8 and 9)

Main control operation of protective control shown in FIGS. 8 and 9 is started when a print command is issued to the image forming apparatus 1. When main control operation is started, processing for applying a voltage to the electrifying unit 7B and the cleaning roller 7C is started (S101); image formation processing is initiated; and a determination is made as to whether or not image formation processing (printing) is completed (S103).

When image formation processing is determined to be completed (YES in S103), processing for applying a voltage to the electrifying unit 7B and the cleaning roller 7C is stopped (S105), and control operation is completed. In the meantime, when image formation processing is determined not to be completed (NO in S103), a determination is made as to whether or not the present moment is transfer timing of the black process cartridge 71 (S107).

At this time, when the present moment is determined to be transfer timing (YES in S107), print transfer current control processing is performed (S109). When print transfer current control processing (S109) is completed, a determination is rendered as to whether or not a predetermined period of time (1 milliseconds in the present embodiment) has elapsed (S115).

When a predetermined period of time is determined not to have elapsed (NO in S115), the apparatus stays in a standby state until a predetermined period of time elapses. In the meantime, when a predetermined period of time is determined to have elapsed (YES in S115), a determination is made as to whether or not the present moment is transfer timing of the yellow process cartridge 71 (S117).

When the present moment is determined not to be transfer timing in S107 (NO in S107), a determination is made as to whether or not the present moment is a time to check the amount of recovery current (S111). When the present moment is determined to be a time to check the amount of recovery current (YES in S111), processing pertaining to S115 is performed after performance of transfer high voltage control (S113). In the meantime, when the present moment is determined not to be a time to check the amount of recovery current (NO in S111), processing pertaining to S115 is performed without performance of transfer high voltage control operation.

When the present moment is determined to be transfer timing in S117 (YES in S117), print transfer current control processing is performed (S119). When print transfer current control processing (S119) is completed, a determination is made as to whether or not a predetermined period of time has elapsed (S125). When the predetermined period of time is determined not to have elapsed yet (NO in S125), the apparatus stays in a standby state until the predetermined period of time elapses. In the meantime, when the predetermined period of time is determined to have elapsed (YES in S125), a determination is rendered as to whether or not the present moment is transfer timing of the magenta process cartridge 73 (S127).

When the present moment is determined not to be transfer timing in S117 (NO in S117), another determination is made as to whether or not the present moment is a time to check the amount of recovery current (S121). When the present moment is determined to be a time to check the amount of recovery current (YES in S121), processing pertaining to S125 is performed after performance of transfer high voltage control similar to that pertaining to S113 has been performed (S123). In the meantime, when the present moment is determined not to be a time to check the amount of recovery current (NO in S121), processing pertaining to S125 is performed without performance of transfer high voltage control.

When the present moment is determined to be transfer timing in S127 (YES in S127), print transfer current control processing is performed (S129). When print transfer current control processing (S129) is completed, a determination is made as to whether or not a predetermined period of time has elapsed (S135).

When the predetermined period of time is determined not to have elapsed (NO in S135), the apparatus stays in a standby state until the predetermined period of time elapses. In the meantime, when the predetermined period of time is determined to have elapsed (YES in S135), another determination is made as to whether or not the present moment is transfer timing of the cyan process cartridge 74 (S137).

When the present moment is determined not to be transfer timing in S127 (NO in S127), another determination is made as to whether or not the present moment is a time to check the amount of recovery current (S131). When the present moment is determined to be a time to check the amount of recovery current (YES in S131), processing pertaining to S135 is performed after performance of transfer high voltage control similar to that pertaining to S113 has been performed (S133). In the meantime, when the present moment is determined not to be a time to check the amount of recovery current (NO in S131), processing pertaining to S135 is performed without performance of transfer high voltage control.

When the present moment is determined to be transfer timing in S137 (YES in S137), print transfer current control processing is performed (S139). When print transfer current control processing (S139) is completed, a determination is made as to whether or not a predetermined period of time has elapsed (S145).

When the predetermined period of time is determined not to have elapsed (NO in S145), the apparatus stays in a standby state until the predetermined period of time elapses. In the meantime, when the predetermined period of time is determined to have elapsed (YES in S145), processing pertaining to S103 is again performed.

When the present moment is determined not to be transfer timing in S137 (NO in S137), another determination is made as to whether or not the present moment is a time to check the amount of recovery current (S141). When the present moment is determined to be a time to check the amount of recovery current (YES in S141), processing pertaining to S145 is performed after performance of transfer high voltage control similar to that pertaining to S113 has been performed (S143). In the meantime, when the present moment is determined not to be a time to check the amount of recovery current (NO in S141), processing pertaining to S145 is performed without performance of transfer high voltage control.

2.2.2. Transfer High Voltage Control (See FIG. 10)

As shown in FIG. 10, transfer high voltage control of the third exemplary embodiment is identical with transfer high voltage control of the second exemplary embodiment. However, in the third exemplary embodiment, the apparatus has the four process cartridges 71 to 74; hence a transfer current shown in FIG. 10 shows a transfer current achieved in each of the process cartridges 71 to 74. The recovery current is a total amount of current from the four cleaning rollers 7C, and the total amount of transfer current is a total amount of four transfer currents.

When transfer high voltage control is started, a determination is made as to whether or not the recovery current currently flowing to the cleaning roller 7C exceeds a first predetermined value (S150). When the recovery current is determined to exceed the first predetermined value; namely, when a positive determination is rendered (YES in S150), another determination is made as to whether or not the present transfer current is the upper limit of the controllable range (S153).

When the present transfer current is determined to be the upper limit of the controllable range (YES in S153), control processing is completed without alteration of the transfer current (an application voltage from the second application voltage circuit 22), and processing returns to main control.

In the meantime, when the present transfer current is determined not to be the upper limit of the controllable range (NO in S153), another determination is made as to whether or not the total amount of transfer current is less than a predetermined amount of electric current (S154). When the total amount of transfer current is determined to be less than the predetermined amount of current (YES in S154), control operation is completed after performance of protective control (S155), and processing returns to main control.

When the total amount of transfer current is determined not to be less than the predetermined amount of electric current (NO in S154), control operation is completed without performance of protective control (S155), and processing returns to main control.

When a positive determination is not rendered in S150 (NO in S150), another determination is made as to whether or not the transfer current is less than the second predetermined current value (S157). When the transfer current is determined not to be less than a second predetermined current value (NO in S157), the third application voltage circuit 23 is controlled such that a transfer current, which is smaller than the present transfer current by a predetermined value, flows (S159), and control is completed, and processing returns to main control.

In the meantime, when the transfer current is determined to be less than the second predetermined current value in S157 (YES in S157), transfer high voltage processing is aborted, and the control voltage is returned to a set voltage (S161); subsequently, control operation is completed, and processing returns to main control.

3. Characteristic of the Image Formation Apparatus of the Third Exemplary Embodiment In the third exemplary embodiment, when a positive determination is rendered even after performance of protective control, the number of transfer rollers 13 subjected to protective control is increased as compared with the number of transfer rollers achieved before the positive determination is again rendered. Hence, early deterioration of a specific transfer roller 13 can be prevented by preventing flow of an excessive transfer current solely to the specific transfer roller 13 while reliably preventing flow of an excessive recovery current to the second application voltage circuit 22.

Fourth Exemplary Embodiment

Figure 11:
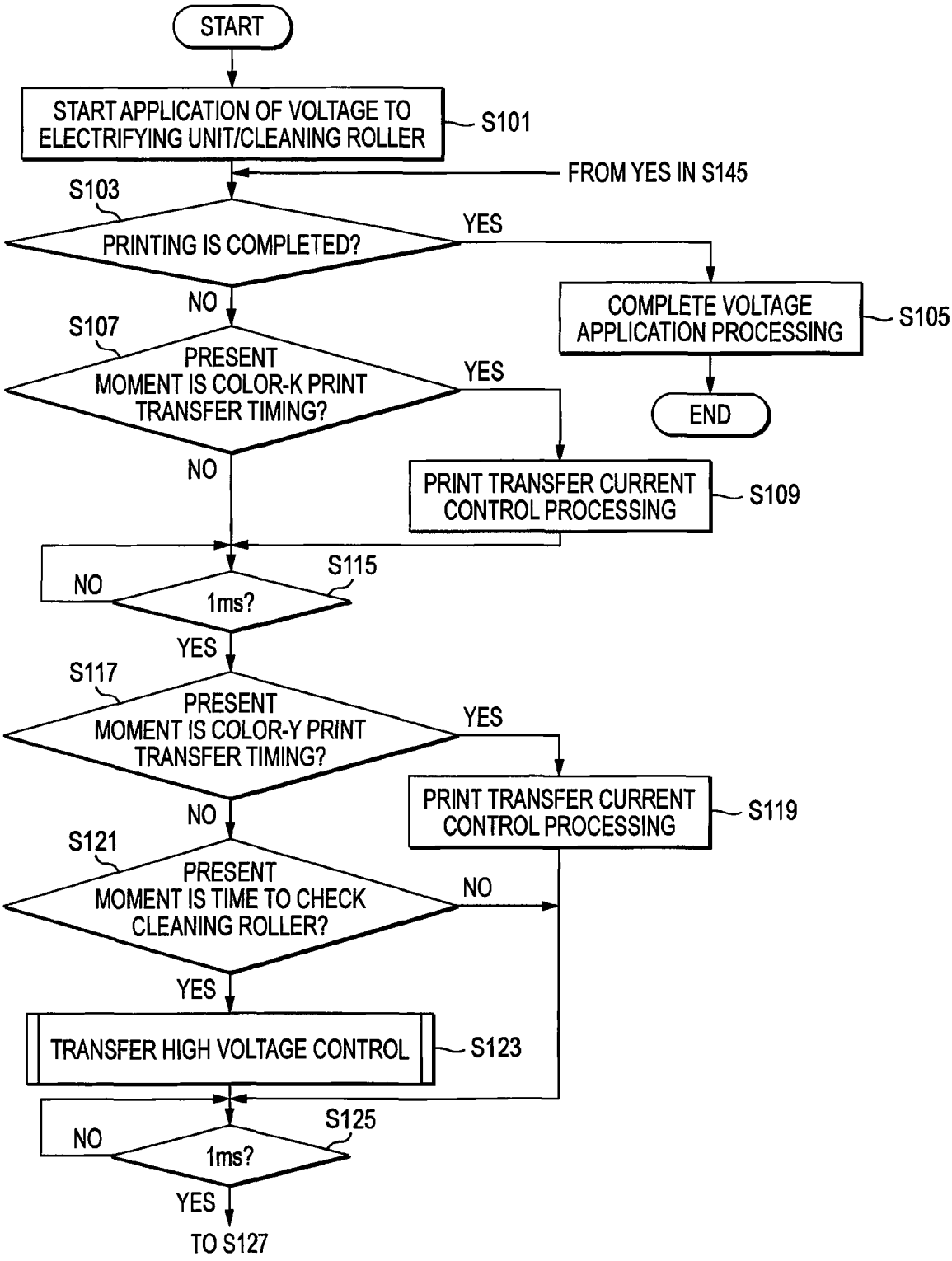
FIG. 11 is a flowchart showing main control operation of the image forming apparatus according to a fourth exemplary embodiment.

In the third exemplary embodiment, the process cartridge 72, the process cartridge 73, and the process cartridge 74 are sequentially subjected to transfer high voltage control after the black process cartridge 71 has been subjected to transfer high voltage control. As shown in FIG. 11, in the fourth exemplary embodiment, only the process cartridges 72 to 74 except the black process cartridge 71 are subjected to transfer high voltage control.

FIG. 11 is a flowchart showing only a difference between main control of the fourth exemplary embodiment and main control of the third exemplary embodiment. In other respects, the main control operation is identical with that of the third exemplary embodiment.

As a result, in the fourth exemplary embodiment, early deterioration of the black transfer roller 13 that is most frequently used can be prevented.

Other Exemplary Embodiments

In the third and fourth exemplary embodiments, a determination is made as to whether or not the total amount of transfer current is less than a predetermined amount of electric current in connection with the overall process cartridges 71 to 74. However, the present invention is not limited to the embodiments. A determination may also be made as to whether or not the total amount of transfer current is less than a predetermined amount of electric current for each of the process cartridges 71 to 74.

When the apparatus is configured so as to determine whether or not the total amount of transfer current is less than a predetermined amount of electric current for each of the process cartridges 71 to 74, application of an electric potential to the cleaning rollers 7C provided on the respective process cartridges 71 to 74 may also be controlled by a different second application voltage circuit 22.

In the third exemplary embodiment, process cartridges are subjected to transfer high voltage control in sequence from a process cartridge placed at an upstream position in the direction of conveyance of a sheet. However, the present invention is not limited to the third exemplary embodiment. For instance, a process cartridge that performs transfer high voltage control may also be randomly selected. Alternatively, process cartridges may also be subjected to transfer high voltage control in ascending sequence from a process cartridge having a small total amount of transfer current (also including a transfer current for printing) acquired since the apparatus was shipped by a manufacturer or since the transfer roller 13 was replaced.

In the above described exemplary embodiments, the total amount of transfer current does not include a transfer current for printing purpose. However, the present invention is not limited to the embodiment, and the total amount of transfer current may also include a transfer current for printing purpose.

The flowing orientation, polarity, and the like, of the transfer current and those of the recovery current are not limited to those described in connection with the embodiments.

In the above embodiments, the recovery current is indirectly detected on the basis of an applied voltage, and the like. However, the present invention is not limited to the embodiment, and the recovery current, and the like, may also be directly detected.

The essential requirement for the present invention is to comply with the gist of the present invention falling within the scope of claims, and the present invention is not limited to the above embodiments.

As described above, a first aspect of the present invention provides an image forming apparatus comprising: an image carrier that holds a developing agent image; a transfer unit that transfers the developing agent image held by the image carrier to a recording medium; a first application unit that controls a voltage applied to the transfer unit; a recovery unit that recovers a developing agent remaining on the image carrier; a second application unit that controls a voltage applied to the recovery unit; a determination unit that determines whether or not the recovery current flowing between the image carrier and the recovery unit exceeds a first predetermined current value; and a control unit that, when the determination unit makes a positive determination to the effect that the recovery current has exceeded the first predetermined current value, performs protective control for controlling the first application unit such that a transfer current flowing between the image carrier and the transfer unit becomes greater than that achieved before a positive determination is rendered.

Thereby, in the invention defined in the above first aspect, when the recovery current exceeds a first predetermined current value, protective control is performed in such a way that a transfer current becomes greater than that achieved before a positive determination is rendered, and a surface potential of the image carrying element decreases. Hence, flow of an inflow current, such as that described in connection with the section "Problem to be solved by the invention", between the image carrier and the recovery unit is prevented.

Therefore, flow of an excessive current to the recovery unit can be prevented, so that an increase in the size of the image forming apparatus can be prevented.

Incidentally, the magnitude of the "recovery current" and the magnitude of the "transfer current," both of which are used in the present specification, signify an absolute value of an electric current regardless of a direction in which the current flows.

As in an invention defined in the first aspect, it is preferable in the invention defined in a second aspect that protective control be performed when a voltage is applied to the recovery unit.

An invention defined in a third aspect is characterized in that the control unit halts protective control when the recovery current becomes less than the second predetermined current value. Hence, it is possible to prevent that protective control is performed more than necessary.

The first predetermined current value and the second predetermined current value may also be identical with each other or may differ from each other.

An invention defined in a fourth aspect is characterized in that, during protective control, the control unit controls the first application unit such that a transfer current, which is smaller than a transfer current achieved at the time of transfer of a developing agent image, flows. Flow of a heavy transfer current can be prevented, and early deterioration of the image carrier can be prevented.

An invention defined in a fifth aspect is characterized in that, when the determination unit makes a positive determination even after performance of protective control, the control unit controls the first application unit such that the transfer current becomes greater than that achieved before the positive determination is again rendered. Therefore, flow of an excessive recovery current can be prevented without fail.

An invention defined in a sixth aspect is characterized in that, there are provided a plurality of image carriers, a plurality of transfer units, and a plurality of recovery units, and the plurality of recovery units are applied with a voltage from the common second application unit; and that, when the determination unit makes the positive determination even after performance of protective control, the control unit increases the number of transfer units that perform protective control than that achieved before the positive determination is again rendered.

As a result, the invention defined in a sixth aspect can prevent early deterioration of a specific image carrier by preventing flow of an excessive transfer current solely to the specific image carrier while reliably preventing flow of an excessive recovery current, as with the invention defined in the fifth aspect.

An invention defined in a seventh aspect is characterized in that there are provided a plurality of image carriers, a plurality of transfer units, and a plurality of recovery units; that a common second application unit applies a voltage to the plurality of recovery units; that at least one of the plurality of image carriers is a black image carrier for holding a black developing agent image; and that the control unit subjects to protective control image carriers except the black image carrier among the plurality of image carriers. Early deterioration of the black image carrier that is most frequently used can be prevented.

An invention defined in an eighth aspect is characterized in that the control unit performs protective control such that a total amount of transfer current flowing along with performance of protective control becomes less than a predetermined amount of electric current. Accordingly, early deterioration of the image carrier can be prevented.

In the invention defined in the eighth aspect, for instance, when a plurality of image carriers are provided, there are specific conceivable means for subjecting a transfer unit having a small total amount of transfer current to protective control in preference; changing the transfer unit that performs protective control every time protective control is performed, and randomly determining a transfer unit that performs protective control.

An invention defined in a ninth aspect is characterized in that, during performance of protective control, the control unit performs protective control such that a total amount of transfer current flowing to any one of the plurality of image carriers becomes less than a predetermined amount of electric current. Early deterioration of an image carrier can be prevented as in the invention defined in the eighth aspect.

What is claimed is:

1. An image forming apparatus comprising:

an image carrier that is configured to hold a developing agent image;

a transfer unit that transfers the developing agent image held on the image carrier to a recording medium;

a first application unit that controls a transfer voltage applied to the transfer unit;

a recovery unit that recovers the developing agent remaining on the image carrier;

a second application unit that controls a recovery voltage applied to the recovery unit;

a determination unit that determines whether or not a recovery current flowing between the image carrier and the recovery unit exceeds a predetermined current value; and a control unit that, when the determination unit makes a positive determination that the recovery current has exceeded the predetermined current value, performs a protective control for controlling the first application unit such that a transfer current flowing between the image carrier and the transfer unit becomes greater than the transfer current achieved before the positive determination is determined.

2. The image forming apparatus according to claim 1, wherein the control unit performs the protective control while the recovery voltage is applied to the recovery unit.

3. The image forming apparatus according to claim 1, wherein the predetermined current value is a first predetermined current value, and when the recovery current becomes less than a second predetermined current value, the control unit halts the protective control.

4. The image forming apparatus according to claim 1, wherein when the protective control is performed, the control unit controls the first application unit such that the transfer current, which is smaller than the transfer current achieved when the developing agent image is transferred to the recording medium from the image carrier, flows.

5. The image forming apparatus according to claim 1, wherein when the determination unit makes the positive determination after performance of the protective control, the control unit controls the first application unit such that the transfer current becomes greater than the transfer current achieved before the positive determination is again determined.

6. The image forming apparatus according to claim 1, further comprising, a plurality of the image carriers;

a plurality of the transfer units; and a plurality of the recovery units, each of the recovery units being applied with a respective recovery voltage from the second application unit;

wherein when the determination unit makes the positive determination after performance of the protective control, the control unit increases the number of transfer units in which the protective control is performed than the number of transfer units achieved before the positive determination is again determined.

7. The image forming apparatus according to claim 6, wherein when the protective control is performed, the control unit performs the protective control such that a total amount of the transfer current flowing to any one of the plurality of image carriers becomes less than a predetermined amount of electric current.

8. The image forming apparatus according to claim 1, further comprising, a plurality of the image carriers;

a plurality of the transfer units; and a plurality of the recovery units, wherein at least one of the plurality of image carriers is a black image carrier for holding a black developing agent image; and the control unit is configured to perform the protective control to the image carriers other than the black image carrier.

9. The image forming apparatus according to claim 1, wherein the control unit performs the protective control such that a total amount of the transfer current after the protective control is performed becomes less than a predetermined amount of electric current.

* * * * *